United States Patent [19]

Greif et al.

[11] 4,049,851

[45] Sept. 20, 1977

[54] MANUFACTURE OF BONDED TEXTILE SHEET MATERIALS

[75] Inventors: Norbert Greif; Rolf Fikentscher, both of Ludwigshafen; Axel Sanner, Frankenthal, all of Germany

[73] Assignee: BASF Aktiengesellschaft, Ludwigshafen, Germany

[21] Appl. No.: 666,461

[22] Filed: Mar. 12, 1976

[30] Foreign Application Priority Data

| | | |
|---|---|---|
| Mar. 21, 1975 | Germany | 2512515 |
| Jan. 30, 1976 | Germany | 2603473 |

[51] Int. Cl.[2] ..... B44D 1/09; C08J 1/44

[52] U.S. Cl. ..... 427/386; 8/115.6; 28/169; 156/181; 156/315; 156/314; 252/8.8; 252/8.9; 427/390 R; 427/412; 428/290; 428/904

[58] Field of Search ..... 156/148, 314, 181, 315, 156/307, 326, 308, 331, 296; 427/390 R, 412, 394, 434 R, , 386; 428/904, 254, 224, 272, 235, 288, 236, 287, 253, 290; 252/8.6, 8.9, 8.8; 8/115.6; 28/73, 74 R; 260/348 R, 633

[56] References Cited

U.S. PATENT DOCUMENTS

| | | | |
|---|---|---|---|
| 2,752,269 | 6/1956 | Condo et al. | 260/348 R |
| 2,829,072 | 4/1958 | Thomas | 260/348 R |
| 2,886,472 | 5/1959 | Condo et al. | 8/115.6 |
| 2,903,381 | 9/1959 | Schroeder | 427/390 R |
| 3,240,721 | 3/1966 | Foroyce | 252/8.8 A |
| 3,398,042 | 8/1968 | Odenthal et al. | 156/331 |
| 3,512,919 | 5/1970 | Cappuccio et al. | 8/115.6 |
| 3,533,902 | 10/1970 | Hoch | 428/904 |

*Primary Examiner*—Charles E. Van Horn
*Assistant Examiner*—J. J. Gallagher
*Attorney, Agent, or Firm*—Keil, Thompson & Shurtleff

[57] ABSTRACT

Bonded textile sheet materials having improved water vapor absorbency can be manufactured by bonding the sheets with polymeric binders and additionally impregnating these sheets with glycidyl ethers, chlorohydrin compounds corresponding thereto and/or reaction products of the chlorohydrin compounds with compounds containing NH groups, and drying the impregnated sheets at elevated temperatures and at the same time fixing the impregnants by means of compounds containing NH groups.

3 Claims, No Drawings

MANUFACTURE OF BONDED TEXTILE SHEET MATERIALS

In the manufacture of synthetic substitutes for leather, the starting materials are, in general, textile sheets consisting predominantly of synthetic fibers, preferably webs which are first impregnated with polymer dispersions or solutions and then dried, the fibers of the non-bonded web being bonded to one another, i.e. adhered to one another, by coagulation of the polymers. A top coating having the appearance of leather is then applied to the bonded webs. This top coating in most cases consists of polyvinyl chloride or polyurethanes. Such materials have excellent mechanical properties and a leather-like hand. However, their water vapor absorbency is very low. For example, in commercial products the water vapor absorption is from 2 to 9 percent by weight if a sample which has been conditioned at 50% relative atmospheric humidity is exposed for 24 hours to an atmosphere saturated with water vapor. In contrast, the water vapor absorbency of natural leather under these conditions is about 20 percent by weight. Incidentally, the water vapor absorbency is a decisive factor in body comfort of shoes and garments, and in sitting comfort of upholstery coverings.

In conventional processes for the manufacture of leather substitutes based on bonded textile sheets, either the water vapor absorption is too low compared to that of leather, as in the case with the materials of German Published Application 2,046,664, or the products are too stiff, above all at low atmospheric humidity, as is the case with the materials described in German Published Application No. 1,965,587.

It is an object of the present invention to provide a process for the manufacture of bonded textile sheet materials of increased water vapor absorbency, which remain flexible at low atmospheric humidity.

We have found that this object is achieved and that bonded textile sheet materials of increased water vapor absorbency may be manufactured by bonding a textile sheet with a polymeric binder, impregnating it with an impregnating agent and drying the impregnated textile sheet at elevated temperatures, by a process wherein the textile sheet is impregnated with from 6 to 40 percent by weight, based on the bonded, impregnated and dried sheet, of a glycidyl ether of the general formula

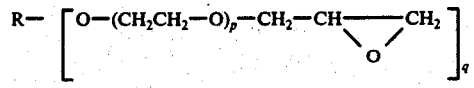

(I)

or of a chlorohydrin compound corresponding to the glycidyl ether, of the general formula

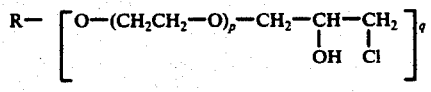

(II)

and/or reaction products of the chlorohydrin compounds (II) with compounds containing NH groups, in which general formulae (I) and (II) R is a divalent to hexavalent aliphatic or cycloaliphatic branched or unbranched hydrocarbon radical of 2 to 13 carbon atoms, $p$ is an integer from 1 to 30 and $q$ is an integer from 2 to 6, and the impregnating agent is fixed to the textile sheet material by compounds containing NH groups. Examples of suitable textile sheets are woven and knitted fabrics, felts and especially nonwoven webs which consist in particular of synthetic, or predominently synthetic, fibers. It is preferred to use webs which have been needle-punched by conventional methods. Particularly suitable textile sheets are those which can be shrunk by a heat treatment by from about 10 to 70%, preferably from 25 to 50%, of their original surface area and which have a weight of from 100 to 1,500, preferably from 150 to 500, g/m². The thickness of the sheets is in general from 1 to 10, preferably from 1.5 to 5, mm. The fibers of the webs are in general of from 0.7 to 4 denier.

The initially non-bonded textile sheets are generally impregnated by conventional methods with a solution or, in most cases, an aqueous dispersion of a polymeric binder, in order to bond them. Suitable binders are the conventional aqueous polymer dispersions, or solutions of polymers in organic solvents. Examples of suitable binders are described, e.g., in the book by M. Sittig, Synthetic Leather from Petroleum, Noyes Development Corp., N.J., London 1969, pages 130 to 135, this literature being incorporated herein by reference.

Suitable polymer dispersions contain, e.g., homopolymers or copolymers of esters of acrylic acid or methacrylic acid. The alcohol component of the ester may be derived from, e.g., an alkanol of 1 to 12 carbon atoms, preferably of 2 to 8 carbon atoms. However, copolymers consisting predominantly of butadiene, acrylamide, methacrylamide and styrene and/or acrylonitrile, with minor amounts of $\alpha,\beta$-monoolefinically unsaturated monocarboxylic acids and/or dicarboxylic acids, e.g. acrylic acid, methacrylic acid and/or itaconic acid and/or their derivatives, e.g. N-methylolacrylamide or N-methylolmethacrylamide and their ethers with alkanols of 1 to 4 carbon atoms, may also be employed. The polymer dispersions may advantageously contain heat sensitizers which cause coagulation of the polymers at elevated temperatures, preferably at from 35° to 85° C, so that on drying the impregnated sheets at elevated temperatures the binder polymer particles do not migrate. Suitable heat sensitizers are, e.g., salts such as calcium chloride and magnesium sulfate, and above all water-soluble alkoxylated polyamines with inverse solubility characteristics, such as are described, e.g., in German Printed Application No. 2,226,269.

Suitable polymers which are used in organic solvents are linear polyurethanes which have been synthesized by conventional methods from polyether-ols or polyester-ols, diisocyanates, e.g. toluylenediisocyanate or 4,4'-diphenylmethanediisocyanate, and diols, e.g. ethylene glycol and 1,4-butanediol, or diamines, e.g. hydrazine, ethylenediamine and 1,6-hexamethylenediamine, as chain extenders. Solvents used are above all those which are miscible with water and alkanols of 1 to 4 carbon atoms. Examples are dimethylformamide, dimethylacetamide and tetrahydrofuran. In general, the polymers are coagulated on the textile sheets by treating the solutions with non-solvents of the stated type.

According to the invention, an impregnant which is one of the glycidyl ethers of the above general formula I and/or a chlorohydrin compound of the above general formula (II) and/or a reaction product of a chlorohydrin compound (II) with compounds containing NH groups is applied to a textile sheet.

The impregnants which may be used, and in which the hydrocarbon radical R may be straight-chain or branched alkyl, can also be applied to the textile sheet together with the binder, i.e., with the aqueous dispersion or with the polymer solution. In a further variant of the process of the invention, the textile sheets are first treated with the impregnants and are then bonded by means of a conventional binder.

The glycidyl ethers (I) which may be used as impregnants are described in detail in, e.g., German Published Application No. 2,246,434. Glycidyl ethers of oxyethylated trimethylolpropane, pentaerythritol and sorbitol with from 1 to 20, preferably from 2 to 10, moles of ethylene oxide per hydroxyl group are particularly suitable for the process of the invention. Examples of particularly suitable glycidyl ethers are the tris-glycidyl ethers of an addition product of 10 moles of ethylene oxide with trimethylolpropane, the tris-glycidyl ether of an addition product of 20 moles of ethylene oxide with pentaerythritol, and the glycidyl ether of an addition product of 24 moles of ethylene oxide with sorbitol.

In general, the impregnants of the invention are employed in the form of aqueous solutions, the concentrations of which are from 5 to 80 percent by weight and preferably from 8 to 40 percent by weight.

The chlorohydrin compounds (II) which can be used as impregnants may be manufactured by conventional processes, e.g. by slow addition of epichlorohydrin to the undiluted polyethers at from 70° to 80° C in the presence of catalytic amounts of $BF_3$-etherate.

The impregnants are fixed on the textile sheet together with compounds containing NH groups. For this purpose it is, as a rule, necessary to heat the impregnated textile sheet to from 40° to 100° C.

If chlorohydrin compounds (II) or their reaction products with compounds containing NH groups are employed as impregnants, the pH is in general brought to above 11.5, preferably to from 12.5 to 13.5, for the fixing operation; alkali, preferably aqueous sodium hydroxide solution, has proved suitable for this purpose. When using the chlorohydrin compounds (II) or their reaction products with compounds containing NH groups, such an increase in the pH enables the said compounds to be fixed by conversion to a reactive form on the textile sheets. When using the glycidyl compounds (I) as impregnants, an increase in pH to above 11.5 for the fixing operation is again advantageous. Compounds containing NH groups which may be used for the fixing operation are, e.g., binders or textile sheets which contain at least 3 percent by weight of NH groups. Preferably, compounds containing NH groups are added when fixing the glycidyl ethers I and the chlorohydrin compounds II. Examples of suitable compounds are ammonia and amines containing several amino groups in the molecule, e.g. diamines of hydrocarbons of 2 to 10 carbon atoms, e.g. alkylenediamines, such as 1,3-diaminopropane and hexamethylenediamine, polyalkylenepolyamines which, as in the case of diethylenetriamine, tripropylenetetramine and tris-(aminopropyl)amine, contain 3 or 4 amino groups and are of 4 to 9 carbon atoms, and also polymers of ethyleneimine, especially polyethyleneimine, whereof the viscosity, measured in 45% strength aqueous solution at 25° C, is from 1 to 25 Pa. s. The compounds containing NH groups are in general added in amounts of from 1 to 40, preferably from 5 to 25, percent by weight, based on the impregnant, in particular on glycidyl ethers (I) and chlorohydrin compounds (II). When using chlorohydrin compounds (II), from 0.7 to 3, preferably from 1 to 2.5, H atoms of an NH group or $NH_2$ group should be available per chlorohydrin group.

In addition to the chlorohydrin compounds (II), or in place thereof, it is possible to use their reaction products with compounds containing NH groups, especially with alkyleneamines containing several amino groups, e.g. alkylenediamines of 2 to 10 carbon atoms, such as 1,3-diaminopropane and hexamethylene-1,6-diamine, and polyalkylenepolyamines, such as diethylenetriamine, tripropylenetetramine and tris(aminopropyl)-amine. Accordingly, suitable amines are in most cases aliphatic amines of 2 to 10 carbon atoms and containing from 2 to 4 amino groups. Such reaction products may be manufactured by simple methods, e.g. by reacting a chlorohydrin, prepared from 50 parts of trimethylolpropane-oxyethylate (obtained from 15 parts of trimethylolpropane and 194 parts of ethylene oxide) and 7.2 parts of epichlorohydrin, in the form of a 40% strength aqueous solution, with 2.5 parts of dipropylenetriamine for from 0.5 to 4 hours at 90° C, and then bringing the reaction mixture to pH 7 with an acid, e.g. HCl.

The amount of compounds containing NH groups which is used in manufacturing the reaction products with the chlorohydrin compounds is in general so chosen as to provide from 0.5 to 3 H atoms of an NH or $NH_2$ group per chlorohydrin group. Amounts of less than 1 H atom of an NH or $NH_2$ group per chlorohydrin group are preferred if the binders employed to manufacture the textile sheets contain NH groups or if other compounds containing NH groups are added. In the particularly preferred embodiment, the amount of amine is so chosen as to provide from 1 to 2 H atoms of an NH or $NH_2$ group per chlorohydrin group. This gives an impregnating solution which is stable on storage and is simple to handle and which can be employed for the process according to the invention by increasing its pH to above 11.5, preferably to from 12.5 to 13.5, and diluting with water, if appropriate.

The textile sheets can also be treated simultaneously with the impregnants of the invention and with the polymer dispersions conventionally used as binders for webs. If the binder contains at least 3 percent by weight of NH groups, it is not necessary to add a further cross-linking agent, containing NH groups, for the fixing process. However, it is preferable to use an additional crosslinking agent containing NH groups. The textile sheet can, e.g., be impregnated with a mixture of a binder dispersion and a solution of a compound containing NH groups and an impregnant of the stated type, and then be heated at from 40° to 90° C. This coagulates the polymer dispersion and gels the impregnant. The water is then evaporated in the conventional manner.

In another embodiment of the process of the invention, the textile sheets are first impregnated with an aqueous solution of the impregnant, the impregnated textile is then heated until gelling occurs, and the water is then removed by evaporation. The textile sheets pretreated in this way can then be bonded by means of polymer dispersions or polymer solutions. From 6 to 40 percent by weight of an impregnant or of a mixture of suitable impregnants of the stated type are applied to the textile sheet. The amount of cross-linking agent employed for fixing the impregnant is in general from 1 to 40, preferably from 5 to 25, percent by weight, based on the impregnant.

The new process gives bonded textile sheet materials which have a leather-like hand and increased water vapor absorption compared to conventional leather substitutes. The bonded textile sheet materials manufactured according to the invention, which can be provided with a top coating, are excellent synthetic leather substitutes which may be used, e.g., to manufacture footwear, garments and upholstery coverings.

In the Examples which follow, parts and percentages are by weight. The water vapor absorption is determined by storing samples for 24 hours at 50% relative atmospheric humidity and 23° C, then weighing them, and thereafter exposing the samples to a saturated water vapor atmosphere for 24 hours and again weighing them. The increase in weight, in %, is quoted as the water vapor absorption.

EXAMPLE 1

A carded web, produced by the conventional method from a mixture of 30 parts of high-bulk polyester fibers, 30 parts of rayon staple and 40 parts of polyamide fibers of from 1.3 to 3.0 denier and staple length from 40 to 60 mm, the web weighing 170 g/m² and being needle-punched with 600 needle punches per cm², is placed for 2 minutes in a waterbath at 75° C; this results in a 45% shrinkage in area. The web is then squeezed off and dried at 120° C. It now weights 320 g/m². 20 parts of this web are impregnated with a solution of 20 parts of the triglycidyl ether of an addition product of 10 moles of ethylene oxide with trimethylolpropane and 4 parts of hexamethylenediamine in 100 parts or water. After removing the excess solution by squeezing off, the impregnated web is exposed to infrared radiation, whereupon the solution gels. The web is then dried for 2 hours in a stream of air at 120° C.

The pretreated web is now impregnated with a mixture of 440 parts of a commercial 50% strength aqueous dispersion of a copolymer of 67% of butadiene, 28% of acrylonitrile and 5% of methacrylic acid, 10 parts of active zinc oxide, 6 parts of colloidal sulfur, 2 parts of the zinc salt of 2-mercaptobenzthiazole, 440 parts of water and 2 parts of a commercial heat sensitizer based on an oxyethylated and oxypropylated amine. The excess liquid is doctored off and the impregnated web is exposed to infra-red radiation, whereupon the latex coagulates. The temperature is raised from 60° to 90° C. After removing the greater part of the water by squeezing off, the impregnated sheet is first dried at 80° C and then heated for 15 minutes at 140° C. The bonded web is washed with water at 60° C for 1 hour and then dried and buffed in the conventional manner.

A leather-like product is obtained, which comprises 49% of web, 17% of hydrophilic agent and 34% of butadiene-acrylonitrile copolymer and has a water vapor absorption of 23%. It has a leather-like soft hand.

EXAMPLE 2

A web manufactured as described in Example 1 and impregnated with the glycidyl ether described there is impregnated with a 12% strength solution of a commercial polyurethane elastomer, having a Shore A hardness of 75, in N,N-dimethylformamide.

After removing the excess polymer solution between squeeze rollers, the impregnated web is soaked in water for three hours at 25° C, then squeezed off, washed with water at 60° C for 1 hour and dried in a stream of air at 120° C. Finally, the surface of the product is buffed. The material thus obtained comprises 45% of web, 16% of hydrophilic agent and 39% of polyurethane elastomer. It has a soft, leathery hand; its water absorption is 21%.

EXAMPLES 3 to 6

A needle-punched web of the type described in Example 1 is impregnated with a mixture of 440 parts of a commercial 50% strength aqueous dispersion of a copolymer of 67 percent by weight of butadiene, 26 percent by weight of acrylonitrile and 5 percent by weight of methacrylic acid, 10 parts of active zinc oxide, 6 parts of colloidal sulfur, 2 parts of the zinc salt of 2-mercaptobenzthiazole, 2 parts of a heat sensitizer based on an oxyethylated and oxypropylated alkylenediamine, 4 parts of iron oxide pigment and 440 parts of water. The excess dispersion is doctored off and the impregnated web is irradiated with infra-red radiators to coagulate the dispersion. The impregnated web is then squeezed off, dried at 80° C and heated at 140° C for 15 minutes. This bonded web is impregnated with the solutions of glycidyl ethers and amines shown in Table 1. After removing the excess solution from the bonded web by doctoring, the web is heated at 80° C by infra-red radiation, then dried at 120° C, washed with water at 60° C for 1 hour, dried at 80° C and then buffed. The composition of the glycidyl ether solutions and the water vapor absorption of the products obtained are shown in Table 1.

TABLE 1

| Example No. | Glycidyl compound corresponding to the general formula I with | Parts | Amine | Parts | Parts of water | Composition of the bonded web: web/binder/hydrophilic agent | Water vapor absorption % |
|---|---|---|---|---|---|---|---|
| 3 | R = Trimethylolpropane radical<br>p = 3.3<br>q = 3 | 18 | Trisaminopropylamine | 1.8 | 100 | 46/14/40 | 24 |
| 4 | As Example 3 | 30 | 20% strength aqueous solution of polyethyleneimine+ | 7 | 100 | 47/18/35 | 28 |
| 5 | R = Pentaerythritol radical<br>p = 5<br>q = 4 | 20 | Hexamethylenediamine | 3.3 | 100 | 49/15/36 | 25 |
| 6 | R = Sorbitol radical<br>p = 4<br>q = 6 | 18 | Ethylenediamine | 0.9 | 100 | 45/14/41 | 25 |

+Viscosity of the 45% strength solution in water at 25° C: 12 Pa.s

EXAMPLE 7

A carded web, produced by the conventional method from a mixture of 30 parts of high-bulk polyester fibers, 30 parts of rayon staple and 40 parts of polyamide fibers of from 1.3 to 3.0 denier and staple length from 40 to 60 mm, the web weighing 170 g/m² and being needle-punched with 600 punches/cm², is placed for 2 minutes in a waterbath at 75° C; this results in a 45% shrinkage in area. The web is then squeezed off and dried at 120° C. It now weighs 320 g/m². 20 parts of this web are impregnated with a solution of 15 parts of a chlorohydrin compound corresponding to the general formula II, where R = a sorbitol radical, $p = 13.4$ and $q = 6$, 1.3 parts of hexamethylenediamine and 0.97 part of sodium hydroxide in 100 parts of water. After removing the excess solution by squeezing off, the impregnated web is exposed to infra-red radiation, whereupon the solution gels. The web is then dried for 2 hours in a stream of air at 120° C.

The pretreated web is now impregnated with a mixture of 440 parts of a commercial 50% strength aqueous dispersion of a copolymer of 67% of butadiene, 28% of acrylonitrile and 5% of methacrylic acid, 10 parts of active zinc oxide, 6 parts of colloidal sulfur, 2 parts of the zinc salt of 2-mercaptobenzthiazole, 440 parts of water and 2 parts of a commercial heat sensitizer based on an oxyethylated and oxypropylated amine. The excess liquid is doctored off and the impregnated web is exposed to infra-red radiation, whereupon the latex coagulates. The temperature is raised from 60° to 90° C. After removing the greater part of the water by squeezing off, the impregnated sheet is first dried at 80° C and then heated for 15 minutes at 140° C. The bonded web is washed with water at 60° C for 1 hour and then dried and buffed in the conventional manner.

A leather-like product is obtained, which comprises 49% of web, 13% of hydrophilic agent and 38% of butadiene-acrylonitrile copolymer. Its water absorption is 21% and its hand is leather-like and soft.

EXAMPLE 8

A web manufactured as described in Example 7 and impregnated with the chlorohydrin compound described there is impregnated with a 12% solution of a commercial polyurethane elastomer, having a Shore A hardness of 75, in N,N-dimethylformamide.

After removing the excess polymer solution between squeeze rollers, the impregnated web is soaked in water for 3 hours at 25° C, then squeezed off, washed with water at 60° C for 1 hour and dried in a stream of air at 120° C. Finally, the surface of the product is buffed. The material thus obtained comprises 45% of web, 16% of hydrophilic agent and 39% of polyurethane elastomer. It has a soft, leathery hand; its water absorption is 21%.

EXAMPLES 9 to 12

A needle-punched web of the type described in Example 7 is impregnated with a mixure of 440 parts of a commercial 50% strength aqueous dispersion of a copolymer of 67% by weight of butadiene, 26% by weight of acrylonitrile and 5% by weight of methacrylic acid, 10 parts of active zinc oxide, 6 parts of colloidal sulfur, 2 parts of the zinc salt of 2-mercaptobenzthiazole, 2 parts of a heat sensitizer based on an oxyethylated and oxypropylated alkylenediamine, 4 parts of iron oxide pigment and 440 parts of water. The excess dispersion is separated off and the impregnated web is irradiated with infra-red radiators to coagulate the dispersion. The impregnated web is then squeezed off, dried at 80° C and heated at 140° C for 15 minutes. The bonded web obtained is impregnated with the solutions of chlorohydrin compounds, amines and sodium hydroxide shown in Table 2. After removing the excess solution from the bonded webs by doctoring, these webs are heated at 80° C by infra-red radiation, dried at 120° C, washed with water at 60° C for 1 hour, dried at 80° C and then buffed.

The composition of the impregnating solutions and the water vapor absorption of the products obtained are shown in Table 2.

TABLE 2

| Example No. | Chlorohydrin compound corresponding to the general formula II, with: | Parts | Amine | Parts | Parts of (solid) NaOH | Parts of water | Composition of the bonded web: web/binder/hydrophilic agent, % | Water vapor absorption % |
|---|---|---|---|---|---|---|---|---|
| 9 | R = Pentaerythritol radical<br>p = 4<br>q = 4 | 20 | Trisaminopropylamine | 4.2 | 2.7 | 100 | 42/42/16 | 23 |
| 10 | R = Trimethylolpropane radical<br>p = 10<br>q = 3 | 15 | Dipropylenetriamine | 1.1 | 1.0 | 100 | 44/44/12 | 21 |
| 11 | R = Sorbitol radical<br>p = 20<br>q = 6 | 10 | 20% strength aqueous solution of polyethyleneimine+) | 1.5 | 0.4 | 100 | 45/45/10 | 20 |
| 12 | R = Trimethylolpropane radical<br>p = 13<br>q = 3 | 25 | Ethylenediamine | 1.03 | 1.4 | 100 | 41/41/18 | 25 |

+)Viscosity of the 45% strength solution in water at 25° C: 12 Pa.s

EXAMPLES 13 to 15

A dispersion-bonded web, manufactured as described in Examples 3 to 6, is impregnated with the solutions of reaction products of chlorohydrin compounds with amines, shown in Table 3, the excess solution is squeezed off and the product is heated at 80° C by infra-red radiation and then dried in a stream of air at 120° C. The resulting textile sheet is then washed for 1 hour with water at 60° C, dried at 120° C and buffed. The water vapor absorption of the products obtained is shown in Table 3.

TABLE 3

| Example No. | Reaction product of chlorohydrin compound according to formula II (parts) with NH compound (parts) | Parts | Parts of water | Addition of further NH compound | Parts | Parts of (solid) NaOH | Composition of the bonded web: web/binder/hydrophilic agent, % | Water vapor absorption % |
|---|---|---|---|---|---|---|---|---|
| 13*) | Chlorohydrin compound with R = Pentaerythritol radical p = 12, q = 4 (15) NH compound: Dipropylenetriamine (1.0) | 15 | 100 | — | — | 1.0 | 43/43/14 | 22 |
| 14*) | Chlorohydrin compound with R = Trimethylolpropane radical p = 12, q = 3 (12) NH compound: hexamethylenediamine (0.65) | 12 | 100 | Hexamethylenediamine | 0.4 | 0.75 | 45/45/10 | 20 |
| 15*) | Chlorohydrin compound with R = Sorbitol radical p = 8, q = 6 (20) NH compound: trisaminopropylamine (1.4) | 12 | 100 | 20% strength aqueous solution of polyethyleneimine as in Example 11 | 2.7 | 1.0 | 44/44/12 | 21 |

*)The reaction products are manufactured by dissolving the stated constituents in 30 parts of water, heating the solutions obtained at 90° C for two hours and then adding 1 N hydrochloric acid to bring the pH to 7. Before processing, a further 70 parts of water are added so that the total amount of water is 100 parts, as stated.

We claim:

1. In a process for the manufacture of bonded textile sheet materials having improved water vapor absorbency by bonding textile sheets with polymeric binders and additionally impregnating the textile sheets with impregnants and drying the impregnated textile sheets at from 40° to 100° C, the improvement wherein the textile sheet is impregnated with from 6 to 40 percent by weight, based on the bonded, impregnated and dried sheet, of an impregnant selected from the group consisting of glycidyl ethers of the general formula (I)

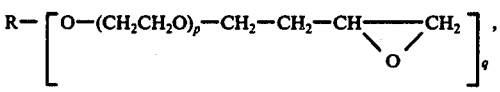

chlorohydrin compounds of the general formula (II)

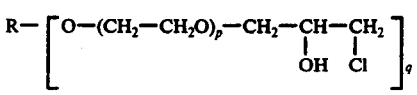

and reaction products of the chlorohydrin compounds (II) with aliphatic amines of 2 to 10 carbon atoms and having from 2 to 4 amino groups, in which general formulae (I) and (II) R is a divalent to hexavalent aliphatic or cycloaliphatic hydrocarbon radical of 2 to 13 carbon atoms, *p* is an integer from 1 to 30 and *q* is an integer from 2 to 6, and the impregnants are fixed to the textile sheets by means of compounds containing NH groups.

2. In a process for the manufacture of bonded textile sheet materials having improved water vapor absorbency by bonding textile sheets with polymeric binders and additionally impregnating the textile sheets with impregnants and drying the impregnated sheets at from 40° to 100° C, the improvement wherein the textile sheet is impregnated with from 6 to 40 percent by weight, based on the bonded, impregnated and dried sheet, of an impregnant selected from the group consisting of glycidyl ethers of the general formula (I)

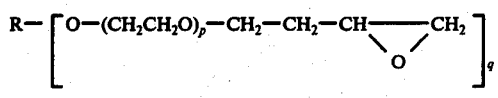

chlorohydrin compounds of the general formula (II)

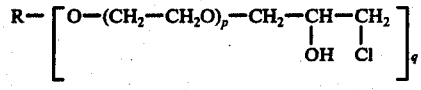

and reaction products of the chlorohydrin compounds (II) with aliphatic amines of 2 to 10 carbon atoms and having from 2 to 4 amino groups, in which general formulae (I) and (II) R is a divalent to hexavalent aliphatic or cycloaliphatic hydrocarbon radical of 2 to 13 carbon atoms, *p* is an integer from 1 to 30 and *q* is an integer from 2 to 6, and the impregnants are fixed to the textile sheets by means of compounds containing NH groups from the group consisting of ammonia, alkylenediamines of 2 to 10 carbon atoms, polyalkylenepolyamines of 4 to 9 carbon atoms, which contain from 3 to 4 amino groups, and polyethyleneimine.

3. In a process for the manufacture of bonded textile sheet materials having improved water absorbency by bonding textile sheets with polymeric binders and additionally impregnating the sheets with impregnants and drying the impregnated textile sheets at from 40° to 100° C, the improvement wherein the textile sheet is impregnated with from 6 to 40 percent by weight, based on the bonded, impregnated and dried sheet, of an impregnant selected from the group consisting of glycidyl ethers of the general formula (I)

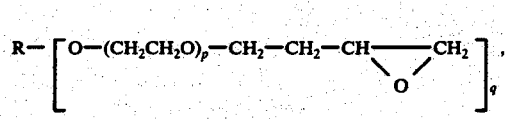

chlorohydrin compounds of the general formula (II)

$$R-\left[O-(CH_2-CH_2O)_p-CH_2-\underset{OH}{\underset{|}{CH}}-\underset{Cl}{\underset{|}{CH_2}}\right]_q$$

and reaction products of the chlorohydrin compounds (II) with aliphatic amines of 2 to 10 carbon atoms and having from 2 to 4 amino groups, in which general formulae (I) and (II) R is a divalent to hexavalent aliphatic or cycloaliphatic hydrocarbon radical of 2 to 13 carbon atoms, $p$ is an integer from 1 to 30 and $q$ is an integer from 2 to 6, and the impregnants are fixed to the textile sheets by means of compounds containing NH groups selected from the group consisting of ammonia, alkylenediamines of 2 to 10 carbon atoms, polyalkylenepolyamines of 4 to 9 carbon atoms, which contain from 3 to 4 amino groups, and polyethyleneimine, the amount of compound containing NH groups being from 5 to 25 percent by weight, based on the glycidyl ether (I) and the chlorohydrin compound (II), and the pH being from 12.5 to 13.5.

* * * * *